US005813284A

United States Patent [19]

Cox

[11] Patent Number: 5,813,284

[45] Date of Patent: Sep. 29, 1998

[54] REMOTE VALVE CONTROL APPARATUS

[75] Inventor: Marvin L. Cox, Wichita, Kans.

[73] Assignee: Wescon Products Company, Wichita, Kans.

[21] Appl. No.: 621,658

[22] Filed: Mar. 26, 1996

[51] Int. Cl.[6] ..... G05G 9/047

[52] U.S. Cl. ..... 74/471 XY; 74/473 P

[58] Field of Search ..... 264/238; 74/471 XY, 74/473 P

[56] References Cited

U.S. PATENT DOCUMENTS

| | | | |
|---|---|---|---|
| 4,493,224 | 1/1985 | Speelman . | |
| 4,536,116 | 8/1985 | Murray . | |
| 4,606,237 | 8/1986 | Crack | 74/471 XY |
| 4,658,666 | 4/1987 | Liu | 74/471 XY |
| 5,225,132 | 7/1993 | Farina . | |
| 5,243,871 | 9/1993 | Weiten . | |
| 5,309,783 | 5/1994 | Doolittle et al. . | |
| 5,372,051 | 12/1994 | Kanematsu et al. . | |
| 5,442,975 | 8/1995 | Osborn . | |
| 5,555,770 | 9/1996 | Dolata et al. | 74/459 |
| 5,562,119 | 10/1996 | Will | 74/471 XY |

*Primary Examiner*—Charles A. Marmor
*Assistant Examiner*—David M. Fenstermacher
*Attorney, Agent, or Firm*—Hovey, Williams, Timmons & Collins

[57] ABSTRACT

A remote valve control apparatus includes a single lever connected to a pair of valve actuators so that two valves can be operated in conjunction with one another from a remote location to carry out plural functions simultaneously. The apparatus includes a housing presenting a pair of elongated cavities within which the actuators are received, and the housing is constructed of a pair of molded housing elements each forming one half of the housing. The housing elements are exactly identical to one another such that a single mold shape can be used to form both elements. The lever is supported on the housing for universal pivotal movement so that upon manipulation of the lever, the actuators are shifted axially between non-actuated and actuated positions. The direction and extent of movement of each actuator is dependent on the direction and extent of movement of the lever relative to the housing.

9 Claims, 1 Drawing Sheet

REMOTE VALVE CONTROL APPARATUS

BACKGROUND OF THE INVENTION

1. Field of the Invention

The present invention relates generally to mechanical remote valve control systems, and more particularly to a remote valve control apparatus having a single lever that is connected to a pair of valve actuators so that two valves can be operated in conjunction with one another to simultaneously carry out plural functions.

2. Discussion of the Prior Art

It is conventional to use a mechanical remote valve control system for controlling plural functions of a hydraulically powered machine such as a ditch digger bucket or the like. Typically, a hydraulic system is provided on the ditch digger for independently lifting and lowering the bucket and moving the bucket from side to side. A pair of piston-and-cylinder assemblies are connected to the bucket for carrying out these two types of movement, and a separate valve is provided in a circuit for controlling each of the assemblies.

One known example of a mechanical remote valve control apparatus includes a housing presenting a pair of elongated cavities within which linear actuators are supported, and a lever connected to the housing and to both actuators for universal pivotal movement so that upon manipulation of the lever, the actuators are shifted axially within the cavities of the housing between non-actuated and actuated positions. The direction and extent of movement of each actuator is dependent on the direction and extent of movement of the lever relative to the housing. Springs are provided on each actuator for biasing the actuator toward the non-actuated position so that when the lever is released, the actuators return to the non-actuated positions.

The housing of the conventional construction is formed by two subassemblies, each of which encases one of the linear actuators. Each subassembly is formed by a pair of different and distinct housing elements that are assembled to form the completed subassembly. In order to secure the two subassemblies together to function as a housing for the overall apparatus, each subassembly must be modified such that all four elements making up the completed housing differ structurally from one another.

One reason that the foregoing approach has been employed is that the subassemblies are of known construction and have independent utility as remote valve control apparatuses for controlling the actuation of a single valve. Thus, in order to employ the subassemblies in a remote valve control apparatus for simultaneously controlling two valves, it is fairly simple to modify each of the subassemblies and secure them together to obtain a housing capable of supporting two actuators and a lever for moving them.

However, this approach to providing a remote valve control apparatus results in a construction formed of four different and distinct elements, each of which must be independently fabricated in order to permit its use in the housing. Thus, the construction is complex and expensive to produce, and uses more material than is necessary to form a housing capable of serving the desired function.

OBJECTS AND SUMMARY OF THE INVENTION

It is an object of the present invention to provide a remote valve control apparatus including a housing that is formed of relatively few, standardized elements, resulting in an inexpensive, lightweight simple construction that is easy to fabricate and assemble.

In accordance with these and other objects evident from the following description of a preferred embodiment of the invention, a remote valve control apparatus includes a housing presenting a pair of elongated cavities each extending in a direction parallel to the other. The housing includes a pair of molded housing elements each forming one half of the housing, and the elements are exactly identical to one another such that a single mold shape can be used to form both elements. A pair of linear actuators are supported within the cavities of the housing for linear movement between actuated and non-actuated positions, and a lever is supported on the housing for universal pivotal movement and includes an upper end adapted for manipulation and a lower end connected to each of the actuators. The means for connecting the lever to the actuators permits universal pivotal movement of the lever relative to each actuator so that upon manipulation of the upper end of the lever, the lever pivots relative to the housing and the actuators, shifting the actuators axially within the cavities of the housing between the non-actuated and actuated positions, the direction and extent of movement of each actuator being dependent on the direction and extent of movement of the lever relative to the housing.

By providing a remote valve control apparatus in accordance with the present invention, numerous advantages are realized. For example, by forming the housing of the apparatus of two exactly identical elements, the number of different parts used to form the housing is reduced to one, standardizing the construction and reducing the number of parts relative to conventional devices. In addition, the invention reduces the cost of manufacturing the apparatus and simplifies assembly of the housing. Likewise, it permits extraneous material to be removed from the housing, reducing the weight of the apparatus.

BRIEF DESCRIPTION OF THE DRAWING FIGURES

The preferred embodiment of the present invention is described in detail below with reference to the attached drawing figures, wherein.

DETAILED DESCRIPTION OF THE PREFERRED EMBODIMENT

Figures 1, 2, 3:
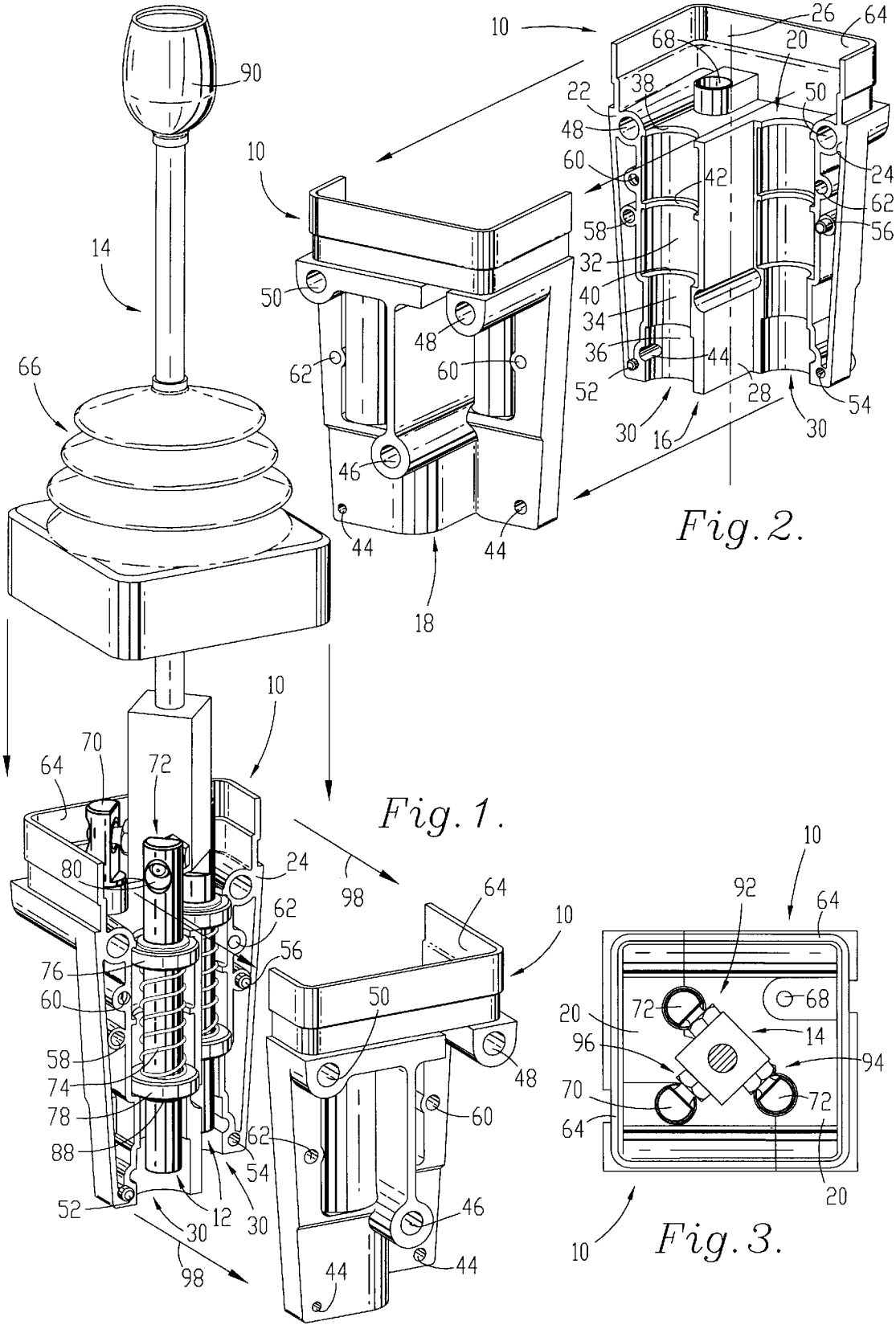
FIG. 1 is an exploded perspective view of a remote valve control apparatus constructed in accordance with the preferred embodiment.
FIG. 2 is a perspective view of a housing element forming a part of the remote valve control apparatus.
FIG. 3 is a sectional view of the apparatus, taken through a lever forming a part of the apparatus.

A remote valve control apparatus constructed in accordance with the preferred embodiment is illustrated in FIG. 1, and broadly includes a housing defined by a pair of molded housing elements 10, a pair of actuator assemblies 12, and a lever 14. Although not shown, a pair of cable assemblies are also provided which extend between the actuators and the valves to be controlled.

The cable assemblies are conventional, and generally include a control cable for transmitting axial shifting movement of the actuator to a mechanically-actuated valve, a tubular conduit within which the cable is supported for axial shifting movement, a threaded connector on the cable for connecting the cable to an actuator, and a fitting on the conduit for permitting the conduit to be secured to the housing of the remote valve control apparatus. The fitting includes a circumferential groove that is gripped in a manner as described below for retaining the conduit fixed to the housing to permit relative axial shifting movement of the cable.

The housing elements 10 each form one half of the housing and are exactly identical to one another such that a single mold shape can be used to form both elements. Preferably, the elements are molded of a synthetic resin material such as a thermoplastic resin. However, other suitable materials may also be used.

As shown in FIG. 2, each housing element 10 includes an inside surface 16, an outside surface 18, an upper end surface 20, and an opposed lower end surface. The inside surface 16 presents a pair of planer faces 22, 24 that are parallel to but offset from one another relative to a central longitudinal axis 26 defined on the inside surface. Each planer face 22, 24 is offset and spaced from the longitudinal axis by a distance equal to the offset and spacing of the other planer face so that when two of the elements 10 are assembled with the inside surfaces bearing against one another, the first planer face of each element bears against the second planer face of the other element. An intermediate planer face 28 extends between and connects the parallel faces 22, 24 together, and the longitudinal axis is disposed within the plane defined by this intermediate face.

Each of the parallel faces 22, 24 is provided with an elongated cavity 30 that extends between the upper and lower end surfaces. Each cavity presents a semi-circular cross-sectional profile, and the cavities in the faces 22, 24 are spaced on opposite sides of the central longitudinal axis 26 by an equal distance so that when the two elements 10 are assembled, the cavities align to define a pair of cylindrical cavities adapted to receive the actuator assemblies 12. Each cavity 30 is stepped, presenting an upper large diameter region 32, an intermediate small diameter region 34, and a lower region 36 of a diameter between the diameters of the upper and intermediate regions. The large diameter region includes structure defining upper and lower shoulders 38, 40 at the extreme ends of the region, as well as a central, circumferentially extending flange that protrudes slightly from the cavity to define a central shoulder 42.

Each element 10 includes a pair of holes 44 that pass through the inside and outside surfaces in a direction transverse to the central longitudinal axis 26. The holes 44 each partially communicate with a different one of the cavities 30, and are spaced on opposite sides of the central longitudinal axis by an equal distance so that when the two elements are assembled, the holes 44 in each element are aligned with the holes 44 of the other element.

Each element also includes three holes 46, 48, 50 that pass through the inside and outside surfaces in a direction transverse to the central longitudinal axis. These holes are spaced from the cavities 30, with one of the holes 46 passing through the central longitudinal axis and the other holes 48, 50 being spaced on opposite sides of the central longitudinal axis by an equal distance so that when the two elements are assembled, the two holes 48, 50 in each element are aligned with the two holes 50, 48 of the other element. Conventional fasteners can thus be passed through the aligned holes of two or more remote valve control apparatuses to secure the apparatuses together. In this manner, several control levers can be supported in a row at a remote control station in order to permit a single user to actuate the levers at the station.

A locating pin 52 protrudes from the first planer face 22 of the inside surface of each housing element, and is spaced on an opposite side of the central longitudinal axis from a hole 54 formed in the second planer face 24. The pin 52 and hole 54 are equidistant from the axis, and are of substantially the same diameter so that when the two elements are assembled, the pin 52 of each element is received in the hole 54 of the other element to align the two elements with one another. If desired, the second planer face 24 may also include a locating pin 56 that is spaced on an opposite side of the central longitudinal axis from a hole 58 formed in the first planer face 22 by an equal distance. The pin 56 and hole 58 are vertically spaced from the pin 52 and hole 54 so that when the housing elements are assembled, the pins 52, 56 of each element are received in the holes 54, 58 of the other element to align the elements with one another.

A threaded hole 60 is formed in the first planer face 22 of the inside surface of each housing element, and is spaced on an opposite side of the central longitudinal axis 26 from a hole 62 extending through the inside and outside surfaces of the element. The hole 62 is of a diameter at least as large as the major diameter of the threaded hole 60, and the two holes are spaced an equal distance from the longitudinal axis so that when the housing elements are assembled, the hole 60 of each element is aligned with the hole 62 of the other element. Conventional threaded fasteners can be inserted into the holes 62 and threaded into the holes 60 to secure the two elements together.

The outside surface 18 of each housing element 10 generally follows the contour of the inside surface 16, with material being added to or removed from the element where possible to increase the strength of the part while removing unnecessary material. This reduces the weight and cost of each element as well as of the overall apparatus.

With reference to FIG. 3, the upper surface 20 of each housing element is generally planer, presenting a polygonal shape having six sides, five of which define four right angles. A flange 64 protrudes upward from the upper surface along three of the sides, and upon assembly of the housing, as shown in FIG. 1, the flanges 64 of the two elements 10 together extend around the circumference of the housing at the upper end and define a means for securing a rubber boot 66 to the housing so that the boot covers the actuator assemblies 12 and the lower end of the lever 14 to prevent debris from interfering with operation of the apparatus. Returning to FIG. 3, a hole 68 extends into the upper surface in a direction parallel to the central longitudinal axis, and is sized for receipt of a plug 70 having a lower threaded end and a free upper end protruding from the upper surface. As shown in FIG. 1, the plug 70 includes a transverse opening for supporting the lever 14 in a manner as described below.

The actuator assemblies 12 are identical to one another, and each assembly broadly includes an actuator 72, a compression spring 74 and a pair of annular bushings 76, 78. The actuator 72 is an elongated cylindrical shaft having opposed axial upper and lower ends. The lower axial end is provided with an axial threaded bore extending into the end and sized for receipt of the connector of the cable assembly.

The upper end of each actuator includes a transverse hole 80 for supporting the lever 14 in a manner as described below. The actuator is stepped along the length thereof, and presents an upper large-diameter region in which the transverse hole 80 is provided, a lower small-diameter region adjacent the lower end of the actuator, and an intermediate region having a diameter between the diameters of the upper and lower regions. A flange is provided between the intermediate and lower regions, and defines a lower shoulder 88 that opposes an upper shoulder defined by the step between the upper and intermediate regions. The bushings 76, 78 guide the shaft 72 and in turn act as springs stops for the spring 74 which is supported on the actuator along the intermediate region. When the actuator assembly 12 is received in one of the cavities defined by the housing, the bushings 76, 78 are held against the upper and lower shoulders 38, 40 of the cavities 30 by the spring 74 and define the non-actuated position of the actuator assembly. If the actuator 72 is depressed by the lever 14, the actuator is shifted toward the lower end of the housing. As a result of this movement, the lower bushing 78 remains in place against the shoulder 40, compressing the spring, and the upper bushing 76 moves with the actuator toward the central shoulder 42 that defines the limit of downward movement. Likewise, when the actuator 72 is lifted relative to the housing, the upper Bushing 76 remains in place against the shoulder 38, compressing the spring 74, and the lower bushing 78 moves with the actuator toward the central shoulder 42 that defines the limit of upward movement. Once the actuator is released from any actuated position, the compression spring 74 forces the actuator back to the non-actuated position with the bushings bearing against the upper and lower shoulders 38, 40.

The lever 14 includes an upper end adapted for manipulation and a lower end including a connection means for connecting the lever to each of the actuators and to the housing. The upper end preferably includes a knob or handle 90 that facilitates manipulation of the lever, and extends through the rubber boot 66 to permit such manipulation. The lower end of the lever presents a square cross-sectional shape having four sides. Three spherical connector elements 92, 94, 96 are secured to the lower end of the lever. The connector elements are exactly identical to one another, each including a first end in the shape of a ball, a second threaded end, and an intermediate length presenting a hexagonal cross-sectional shape for facilitating threading of the element to the lever. The elements 92, 94, 96 are provided on three of the four sides of the lower end of the lever so that two of the elements 92, 94 are diametrically opposed to one another and the third element 96 is offset from each of the other two by 90 degrees, extending in a direction generally transverse to the direction in which the other two elements extend. Each of the diametrically opposed elements 92, 94 are sized for receipt in the holes 80 of the actuators 72 and the third element 96 is sized for receipt in the hole of the plug 70. The connection provided by this arrangement permits universal pivotal movement of the lever relative to the housing and the actuators so that upon manipulation of the upper end of the lever, the lever pivots relative to the housing and the actuators, shifting the actuators axially within the cavities 30 of the housing between the non-actuated and actuated positions. The direction and extent of movement of each actuator is dependent on the direction and extent of movement of the lever relative to the housing.

For example, both actuators 72 can be shifted downward an equal distance by pushing the lever directly away from the plug 70, and both actuators may be lifted an equal distance by pulling the lever directly toward the plug. If the lever is pushed directly toward either actuator, that actuator is depressed while the other is lifted by an equal distance. Thus, it can be understood that any combination of movements of the actuators can be carried out simply by manipulating the lever in the appropriate fashion.

During assembly of the apparatus, the plug 70 is secured in the hole in the upper surface of one of the elements 10, the lever 14 is connected to the actuators 72 and the plug, and the actuators are positioned in the cavities 30 of one of the elements. The two elements are then aligned with one another and pushed together in a direction opposite to the direction of the arrows 98 in FIG. 1. The pins 52, 56 of each element engage the holes 54, 58 of the other element to locate the elements relative to one another, simplifying assembly and insuring proper assembly of the parts. Threaded fasteners of suitable length are then inserted into the holes 62 of the elements and threaded into the holes 60 to hold the housing elements together. If desired, two or more apparatuses can be secured together by aligning the holes 46, 48, 50 of the apparatuses and passing suitable fasteners through the holes to secure the apparatuses together. A cable assembly is secured to each actuator by threading the connector of the cable into the threaded opening at the lower end of the actuator. The conduit of the cable assembly is then pushed into the cavity until the circumferential groove formed in the fitting is aligned with the holes 44. The fitting is held in place within the cavity by a fastener that is inserted through the holes 44 and engages the circumferential groove of the fitting. Thus, movement of the actuator 72 shifts the cable relative to the conduit. Thereafter, manipulation of the lever carries out the appropriate shifting movement of the actuators in the manner described above.

Although the present invention has been described with reference to the preferred embodiment, it is noted that equivalents may be employed and substitution made herein without departing from the scope of the invention as recited in the claims.

What is claimed is:

1. A remote valve control apparatus comprising:

a housing presenting first and second elongated cavities each configured for receiving an actuator therein, said first cavity extending in a direction parallel to the second cavity, the housing including a pair of molded housing elements each forming one half of the housing, the housing elements being exactly identical to one another such that a single mold shape can be used to form both elements;

a pair of linear actuators each supported within one of the cavities of the housing for linear movement between actuated and non-actuated positions;

a lever including an upper end adapted for manipulation and a lower end including a connection means for connecting the lever to each of the actuators, the connection means permitting universal pivotal movement of the lever relative to each actuator; and a support means for supporting the lever on the housing for universal pivotal movement relative to the housing so that upon manipulation of the upper end of the lever, the lever pivots relative to the housing and the actuators, shifting the actuators axially within the cavities of the housing between the non-actuated and actuated positions, the direction and extent of movement of each actuator being dependent on the direction and extent of movement of the lever relative to the housing.

2. The apparatus as recited in claim 1, wherein each housing element includes an inside surface defining a central longitudinal axis, an outside surface, and an upper end surface, the inside surface presenting a pair of axially extending cavity halves extending parallel to one another and being spaced on opposite sides of the central longitudinal axis by an equal distance so that when the two elements are assembled, the cavity halves align to define a pair of cavities adapted to receive the actuators.

3. The apparatus as recited in claim 2, wherein each housing element includes a pair of holes passing through the inside and outside surfaces, the holes being spaced on opposite sides of the central longitudinal axis from one another by an equal distance so that when the two elements are assembled, the holes of the two elements are aligned.

4. The apparatus as recited in claim 2, wherein each housing element includes a pin protruding from the inside surface and a hole extending into the inside surface, the pin and hole being spaced on opposite sides of the central longitudinal axis from one another by an equal distance so that when the two elements are assembled, the pin of each element is received in the hole of the other element to align the elements with one another.

5. The apparatus as recited in claim 2, wherein each housing element includes a hole extending into the upper surface for receiving the support means.

6. The apparatus as recited in claim 2, wherein each cavity half includes a movement limiting means for limiting the range of linear movement of the actuator that is supported in the cavity upon assembly of the apparatus.

7. A housing for a remote valve control apparatus, wherein the apparatus is adapted for use in supporting a pair of linear actuators for linear movement between actuated and non-actuated positions, and a lever having an upper end adapted for manipulation and a lower end connected to each of the actuators for relative universal pivotal movement, the lever being supported on the housing for universal pivotal movement relative to the housing so that upon manipulation of the upper end of the lever, the lever pivots relative to the housing and the actuators, shifting the actuators between the non-actuated and actuated positions, the housing comprising:

a pair of molded housing elements each forming one half of the housing, the housing elements being exactly identical to one another such that a single mold shape can be used to form both elements, each housing element including an inside surface defining a central longitudinal axis, an outside surface, and an upper end surface, the inside surface presenting a pair of axially extending cavity halves extending parallel to one another and being spaced on opposite sides of the central longitudinal axis by an equal distance so that when the two elements are assembled, the cavity halves align to define a pair of cavities adapted to receive the actuators.

8. The apparatus as recited in claim 7, wherein each housing element includes a pair of holes passing through the inside and outside surfaces, the holes being spaced on opposite sides of the central longitudinal axis from one another by an equal distance so that when the two elements are assembled, the holes of the two elements are aligned.

9. The apparatus as recited in claim 7, wherein each housing element includes a pin protruding from the inside surface and a hole extending into the inside surface, the pin and hole being spaced on opposite sides of the central longitudinal axis from one another by an equal distance so that when the two elements are assembled, the pin of each element is received in the hole of the other element to align the housing elements with one another.

* * * * *